US010525653B2

(12) United States Patent
Adami

(10) Patent No.: US 10,525,653 B2
(45) Date of Patent: Jan. 7, 2020

(54) PLANT AND METHOD FOR PRODUCING CORRUGATED CARDBOARD WITH GLUING DEFECT DETECTOR

(71) Applicant: Fosber S.p.A., Pescaglia (IT)

(72) Inventor: Mauro Adami, Viareggio (IT)

(73) Assignee: Fosber S.p.A., Pescaglia (IT)

( * ) Notice: Subject to any disclaimer, the term of this patent is extended or adjusted under 35 U.S.C. 154(b) by 297 days.

(21) Appl. No.: 15/564,462

(22) PCT Filed: Jul. 27, 2016

(86) PCT No.: PCT/EP2016/067895
§ 371 (c)(1),
(2) Date: Oct. 5, 2017

(87) PCT Pub. No.: WO2017/036685
PCT Pub. Date: Mar. 9, 2017

(65) Prior Publication Data

US 2018/0079162 A1 Mar. 22, 2018

(30) Foreign Application Priority Data

Aug. 31, 2015 (IT) ..... UB2015A3309

(51) Int. Cl.
*B31F 1/28* (2006.01)

(52) U.S. Cl.
CPC ..... *B31F 1/2831* (2013.01); *B31F 1/2804* (2013.01); *B31F 1/285* (2013.01); *B31F 1/289* (2013.01); *B31F 1/2818* (2013.01); *B31F 1/2822* (2013.01); *B31F 1/2863* (2013.01)

(58) Field of Classification Search
CPC ..... B31F 1/289; B31F 1/2863; B31F 1/285; B31F 1/2831; B31F 1/2804; B31F 1/2818
USPC ..... 156/462, 350
See application file for complete search history.

(56) References Cited

U.S. PATENT DOCUMENTS

| | | | | |
|---|---|---|---|---|
| 5,437,749 | A | 8/1995 | Pipkorn et al. | |
| 5,581,353 | A * | 12/1996 | Taylor | B31F 1/2831 250/559.23 |
| 5,663,565 | A | 9/1997 | Taylor | |
| 5,663,656 | A | 9/1997 | Wilson et al. | |
| 5,829,951 | A | 11/1998 | Adami | |
| 5,837,974 | A * | 11/1998 | Sissons | B31F 1/284 219/388 |
| 5,951,454 | A | 9/1999 | Adami | |
| 6,092,452 | A | 7/2000 | Adami | |
| 6,165,117 | A | 12/2000 | Adami | |
| 6,684,749 | B2 | 2/2004 | Adami | |
| 6,722,243 | B2 | 4/2004 | Adami | |

(Continued)

FOREIGN PATENT DOCUMENTS

| | | | |
|---|---|---|---|
| DE | 19955917 | A1 | 5/2001 |
| EP | 1362691 | A2 | 11/2003 |

(Continued)

*Primary Examiner* — Robert F Long
*Assistant Examiner* — Xavier A Madison
(74) *Attorney, Agent, or Firm* — Breiner & Breiner, L.L.C.

(57) ABSTRACT

The plant includes a single facer for the production of a corrugated board. Video cameras detect any gluing defects or other defects of the corrugated cardboard. An image processing unit and a central control unit provide information about the detected defects and can act on one or more operating parameters of the plant.

28 Claims, 3 Drawing Sheets

(56) References Cited

U.S. PATENT DOCUMENTS

| | | | | |
|---|---|---|---|---|
| 7,291,243 | B2 | 11/2007 | Adami | |
| 7,921,892 | B2 | 4/2011 | Baierl et al. | |
| 8,241,454 | B2 | 8/2012 | Kraus | |
| 8,342,068 | B2 | 1/2013 | Adami | |
| 8,714,223 | B2 | 5/2014 | Adami et al. | |
| 2003/0000988 | A1* | 1/2003 | Ruhland | B31F 1/2836 226/20 |
| 2010/0195115 | A1* | 8/2010 | Mouri | B31F 1/2831 356/601 |
| 2012/0193026 | A1 | 8/2012 | Adami | |
| 2015/0360436 | A1* | 12/2015 | Ohira | B31F 1/24 156/250 |
| 2018/0215061 | A1* | 8/2018 | Bayer | B26D 5/005 |
| 2019/0025227 | A1* | 1/2019 | Yamada | B31F 1/2831 |

FOREIGN PATENT DOCUMENTS

| | | | |
|---|---|---|---|
| EP | 1710183 | A1 | 10/2006 |
| JP | H01267404 | A | 10/1989 |
| WO | 2005087460 | A1 | 9/2005 |

* cited by examiner

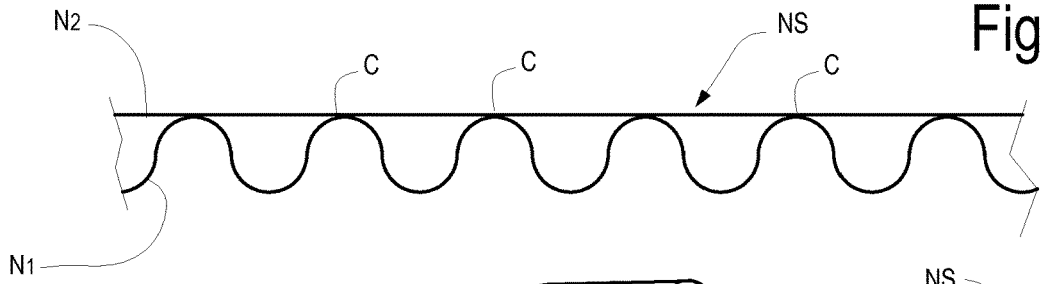
Fig.2
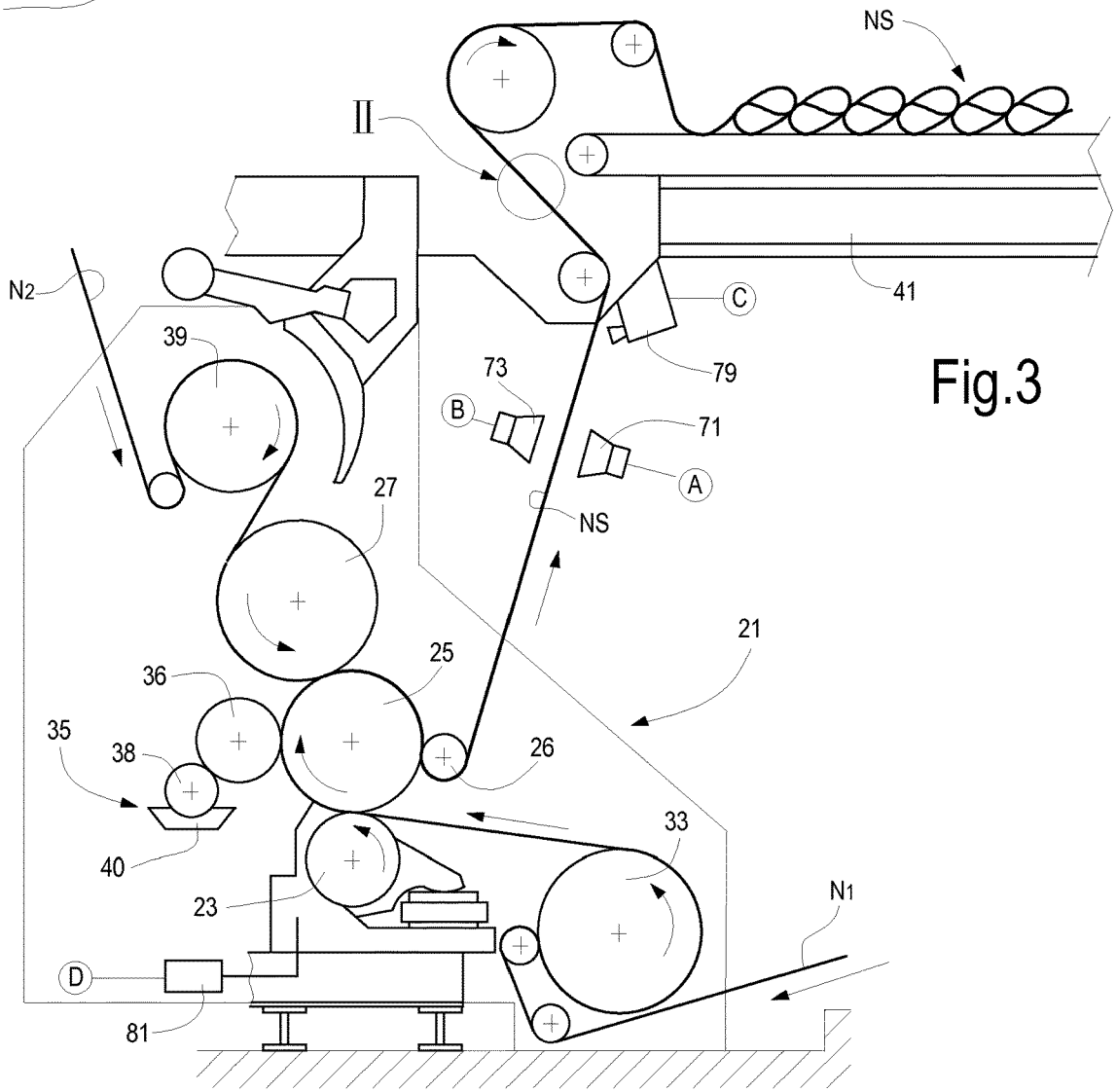
Fig.3
Fig.3A
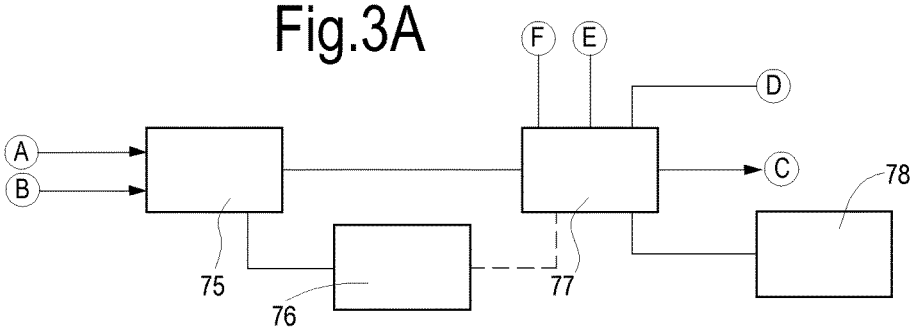

PLANT AND METHOD FOR PRODUCING CORRUGATED CARDBOARD WITH GLUING DEFECT DETECTOR

TECHNICAL FIELD

The present invention relates to plants for the production of corrugated cardboard. More particularly, embodiments described herein refer to plants for the production of corrugated cardboard, provided with systems for detecting cardboard defects, particularly gluing defects.

BACKGROUND ART

For the production of corrugated cardboard, plants comprising one or more single facers are used, to each of which two smooth cardboard sheets are fed. A first smooth cardboard sheet is corrugated in the single facer between a first corrugating roller and a second corrugating roller. The first, corrugated cardboard sheet is glued to the second, smooth cardboard sheet by means of a pressure device, for example a belt or a roller. In this way a so-called single-faced corrugated cardboard, composed of a corrugated sheet and a smooth sheet, also called cover, can be obtained. The single-faced corrugated cardboard is fed, together with a third smooth cardboard sheet, to a series of hot plates where the single-faced corrugated cardboard is glued to the third smooth cardboard sheet, so as to form a second cover.

In some plants more single facers are provided, each of which produces a single-faced corrugated cardboard. Several single-faced corrugated cardboards are simultaneously fed to the series of hot plates, together with the third smooth cardboard sheet, in order to form a composite corrugated cardboard. The composite corrugated cardboard in this case will be constituted by two outer covers and a plurality of corrugated sheets interposed between the covers. Adjacent corrugated sheets are separated from one another by an intermediate smooth sheet.

The corrugated cardboard sheet coming out from the series of hot plates is subsequently trimmed, eliminating the longitudinal trimmings, and divided in longitudinal strips, each of which can be suitably scored. The strips are subsequently transversely cut to form corrugated cardboard sheets with score lines, for the production of boxes or other similar articles.

A plant of this type for the production of corrugated cardboard is described for example in U.S. Pat. No. 5,437,749.

To detect any defects of the corrugated cardboard several systems have been studied, particularly based on ultrasonic sensors. Devices for the detection of gluing defects are described in U.S. Pat. No. 7,921,892 and in DE 19955917.

Ultrasonic systems have proved to be not very efficient, and are not able to differentiate among different types of gluing defects.

JP-A-1267404 discloses a system for detecting gluing defects on corrugated cardboard, wherein an optical system is used; this optical system having an illuminator generating a light line oriented transversally relative to the crests of the single-faced corrugated cardboard, and a video camera. The defects are detected as alteration of the detected image with respect to a theoretical corrugated line.

U.S. Pat. No. 5,663,656 discloses a device for detecting characteristics of a corrugated cardboard by means of an optical device. The device detects the intensity of a characteristic of the corrugated cardboard and identifies its oscillating frequency.

WO-A-2005/087460 discloses an optical system for detecting the amount of glue applied onto the crests of the corrugated cardboard sheet before coupling thereof to a smooth cardboard sheet. This system is not suitable for the detection of gluing defect.

The known systems and methods have limited functionalities and do not allow an automatic management of the production line.

A need therefore exists, for corrugated cardboard production plants, which are provided with more efficient systems for the detection of gluing defects, particularly on the single-faced corrugated cardboard produced by the single facer.

SUMMARY OF THE INVENTION

According to a first aspect, a plant for the production of corrugated cardboard is provided, comprising in combination:

- a single facer, including: a first corrugating roller and a second corrugating roller cooperating with each other to corrugate a first cardboard sheet; a pressing member to glue the first cardboard sheet, corrugated by means of the first corrugating roller and of the second corrugating roller, to a second smooth cardboard sheet and form a single faced corrugated cardboard;
- a first unwinding device to feed the first cardboard sheet to the single facer;
- a second unwinding device to feed the second cardboard sheet to the single facer;
- a feeding path for the single-faced corrugated cardboard towards a series of hot plates;
- a third unwinding device to feed a third sheet of smooth cardboard to the series of hot plates, the third cardboard sheet being glued to the single-faced corrugated cardboard on said hot plates, in order to form a composite corrugated cardboard;
- a central control unit.

A viewing system is also provided, comprising: a first video camera arranged along the cardboard feeding path, configured and arranged to acquire images of a first face of the cardboard; and an image processing unit, which interfaces the first video camera and processes images acquired by the first video camera and detects defects in cardboard gluing or corrugating.

The video camera can be arranged in any suitable position along the cardboard path. For example and preferably, it can be arranged in a feeding area of the single-faced corrugated cardboard, i.e. between the single facer and the series of hot plates, to detect gluing defects of the single-faced corrugated cardboard coming out from the single facer. In case more single facers are provided, a video camera can be provided per each path of each single-faced corrugated cardboard coming out from each single facer.

Alternatively, or in combination, a video camera can be provided along the path of the composite corrugated cardboard coming out from the series of hot plates.

Moreover, the plant may comprise a removing system or device for removing cardboard defective portions, i.e. presenting gluing defects or other defects. Moreover, the plant may comprise a tracking system to track the cardboard defective portion up to the removing device. In this context, tracking means an operation which allows to know, with sufficient approximation, when a cardboard defective area or portion, identified by the viewing system, achieves a given position of the line, for example particularly the area where devices for removing cardboard defective portions are located.

As will be described in greater detail hereunder, tracking can be obtained by applying, by means of a marking device, a mark at the beginning of the defective portion, or at the beginning and at the end of the defective portion, or along the entire defective portion. For example, an ink applicator can be used, the ink being possibly visible in the infrared and not visible to the human eye. In some embodiments the tracking system may comprise one or more encoders to identify and track the position of the defective portion. One or more encoders can be used as a single tracking means, or in combination with one or more marking devices.

With a system of this type, it is possible to track defects produced either in the single facer or on the hot plates. It is also possible to identify defects present in the cardboard reel, or tears, spots or other defects of any type, generated in any manner along the processing line.

Preferably, based on the width of the cardboard, more video cameras can be provided, adjacent to each other transversely to the feed direction, to cover the whole width of the cardboard.

Preferably, video cameras are provided on both the sides of the cardboard path, to detect images of both two opposite faces of the cardboard.

According to the position of the video cameras, of the type of video cameras, and/or of the images processing software used by the image processing unit, the data that can be extracted by the images detected by the video cameras can be used to identify the kind of defect and act, by means of a control unit, on the basis one or more operative parameters, i.e. operating parameters, of one or more plant machines or sections, for example parameters of the single facer or parameters of the series of hot plates.

In advantageous embodiments, the removing systems or devices, for removing the defective cardboard, may comprise transversal cutters and removing members for removing defective corrugated cardboard sheets. For example, diverting members may be provided along the cardboard feeding path, these diverting members discharging the defective sheets towards a waste collecting area. In other embodiments, it may be provided to cut the defective portions in formats different from those of non-defective sheets, to facilitate manual removal thereof from the pile of cardboard sheets formed at the exit of the plant.

In some embodiments, the central control unit and/or the image processing unit may be configured to identify or classify the kind of detected defect. This may be done, for example, by comparing some parameters of the detected image and a data bank of reference images. The comparison may result in the identification of the type of defect, for example a gluing defect or a tear or a fold of the cardboard. The gluing defect can be classified in a plurality of classes, for example delamination, bubble, blister. The central control unit can be so programmed as to act on one or more operative parameters, i.e. operating parameters, of a plant portion, for example the single facer or the hot plates, to reduce or eliminate the defect. The parameter(s) onto which the central control unit acts can be identified based on the classification of the defect realized as described above.

According to a further aspect, a method for the production of corrugated cardboard is provided, comprising the following steps:

feeding a first cardboard sheet and a second cardboard sheet to a single facer;

corrugating the first cardboard sheet and gluing the first corrugated cardboard sheet to the second cardboard sheet, forming a single-faced corrugated cardboard;

feeding the single-faced corrugated cardboard and a third, smooth cardboard sheet to a series of hot plates;

gluing the single-faced corrugated cardboard to the third, smooth cardboard sheet by means of the series of hot plates to obtain a composite corrugated cardboard;

acquiring, by means of at least a first video camera, images of a first surface of the cardboard;

detecting any gluing defects of the cardboard by processing the images acquired by the first video camera;

tracking a defective cardboard portion up to a defective portion removing device;

removing a cardboard portion containing the gluing defect.

In some embodiments, the method provides for modifying, automatically or semi-automatically, one or more parameters of the plant according to the detected defect.

Further advantageous features and embodiments of the plant and of the method of the invention are described hereafter with reference to the attached drawings, which show a non-limiting practical embodiment, and in the attached claims, forming an integral part of the present description.

BRIEF DESCRIPTION OF THE DRAWINGS

The invention will be better understood by following the description and the accompanying drawing, which shows non-limiting practical embodiments of the invention. More particularly, in the drawing:

FIG. 2 shows an enlarged schematic section of a portion of single-faced corrugated cardboard sheet, indicated with II in FIG. 3;

FIG. 3 shows an enlargement of the single facer;

FIG. 3A shows a diagram of a central control unit and of an image processing unit combined with the plant of FIGS. 1A to 1D.

DETAILED DESCRIPTION OF EMBODIMENTS

Figure 1:
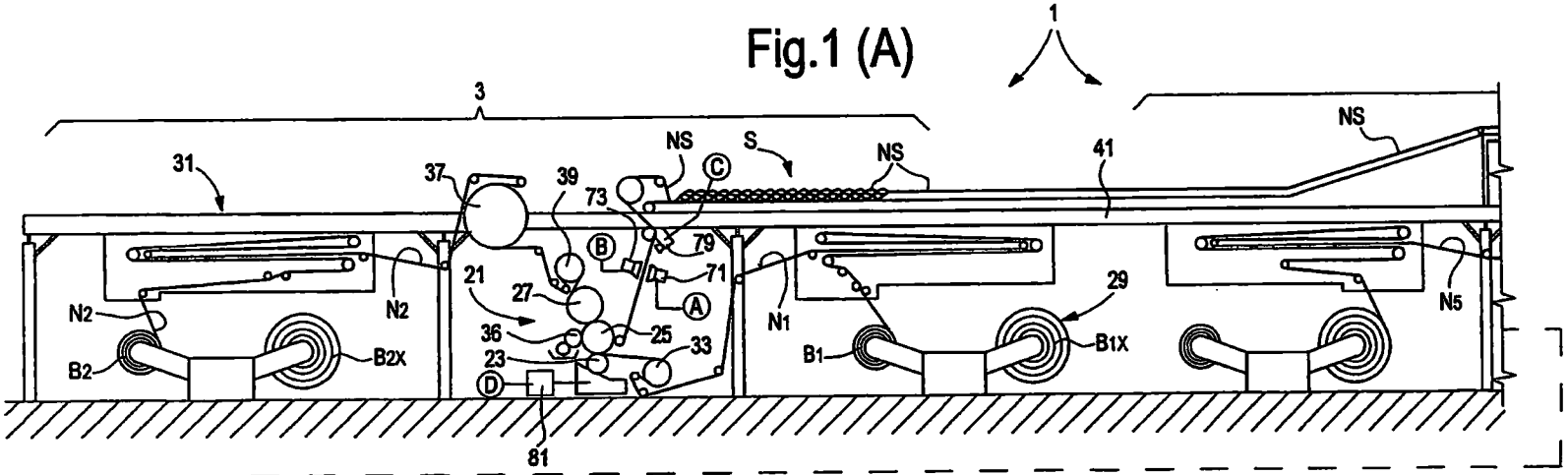
FIGS. 1A to 1D show portions of a corrugated cardboard production plant, these portions being arranged in sequence along the cardboard feeding path.
Figure 1:
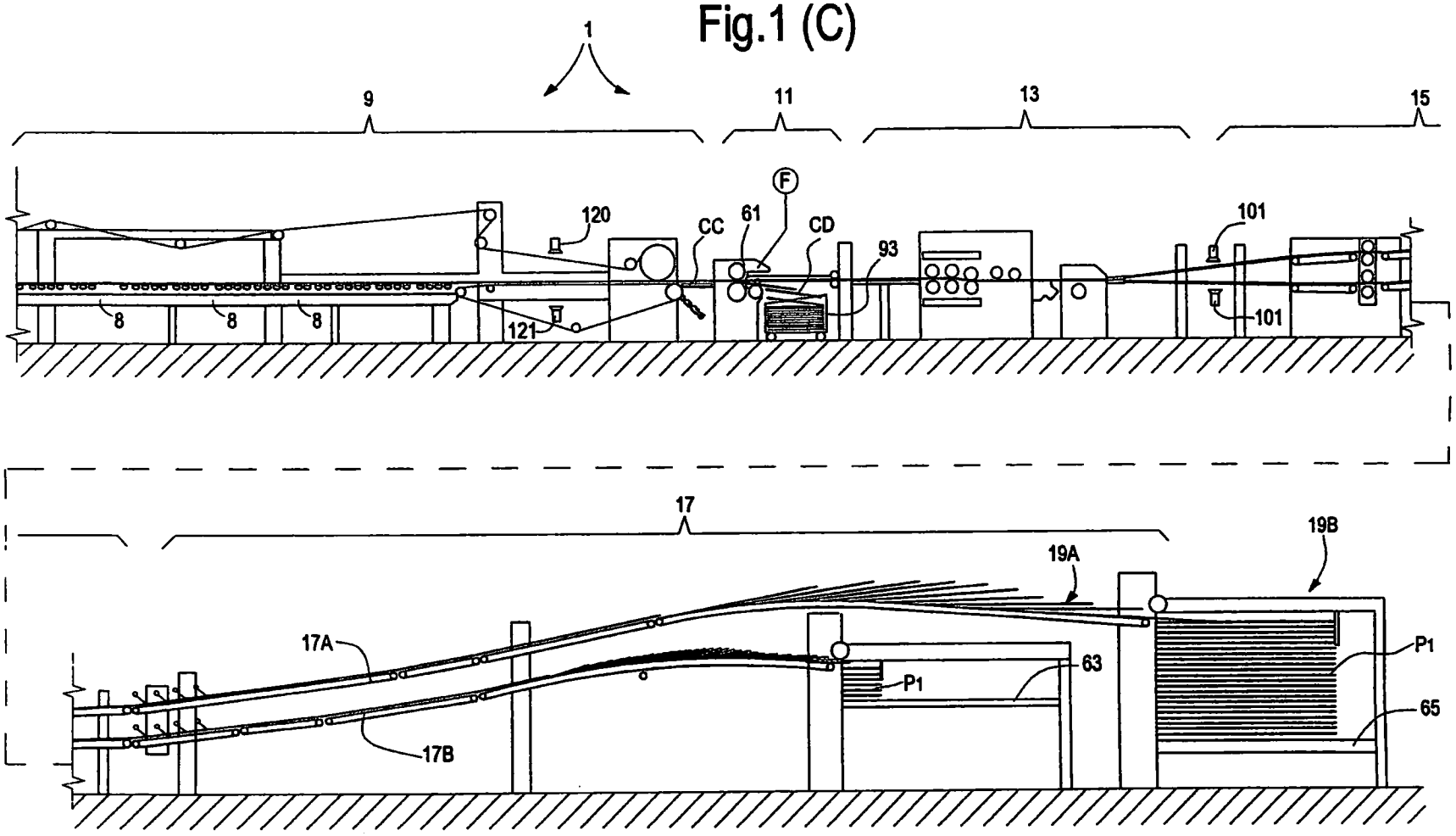

The detailed description below of example embodiments is made with reference to the attached drawings. The same reference numbers in different drawings identify the equal or similar elements. Furthermore, the drawings are not necessarily to scale. The detailed description below does not limit the invention. The protective scope of the present invention is defined by the attached claims.

In the description, the reference to "an embodiment" or "the embodiment" or "some embodiments" means that a particular feature, structure or element described with reference to an embodiment is comprised in at least one embodiment of the described object. The sentences "in an embodiment" or "in the embodiment" or "in some embodiments" in the description do not therefore necessarily refer to the same embodiment or embodiments. The particular features, structures or elements can be furthermore combined in any adequate way in one or more embodiments.

In the attached drawing, number 1 generically indicates as a whole a plant for the producing scored sheets of corrugated cardboard from continuous smooth cardboard sheets.

In the illustrated embodiment, the plant provides for the production of double-wave corrugated cardboard sheets, i.e. with two sheets of corrugated cardboard interposed between two smooth cardboard sheets, or covers, and a smooth cardboard sheet interposed between the two corrugated cardboard sheets. Moreover, the plant is configured to provide two stacks of sheets on two adjacent stackers.

However, it should be understood that the features described hereunder, related to the detection system for detecting corrugated cardboard defects, may be used in the same manner in plants provided with a different number of single facers, and thus suitable to produce a corrugated cardboard sheet comprising a different number of corrugated cardboard sheets. Also the stacking systems may be different, for example to form a single stack, or more than two stacks of cardboard sheets. Similarly, the series of hot plates and the longitudinal slitter and scorer stations, described hereunder, may be configured in a manner different than the one described and illustrated herein.

With reference to the illustrated embodiment, the plant comprises a first section 3, for the production of a first single-faced corrugated cardboard sheet, a second section 5 for the production of a second single-faced corrugated cardboard sheet, a third section 7 for feeding the two single-faced corrugated cardboard sheets and a smooth cardboard sheet to a series of hot plates 8, a section 9 comprising the series of hot plates 8 and corresponding accessories. A composite corrugated cardboard sheet exits from section 9, this corrugated cardboard sheet being formed by the set of single-faced corrugated cardboard sheets and of the further smooth cardboard sheet glued to them, said smooth cardboard sheet forming a second cover of the composite corrugated cardboard sheet.

Downstream of section 9, a section 11 is provided, wherein devices for removing trimmings are arranged, and downstream of section 11, a section 13 is provided for longitudinally slitting and scoring the corrugated cardboard coming from section 9 of hot plates, in order to divide the corrugated cardboard sheet into a plurality of longitudinal corrugated cardboard strips.

Moreover, the plant 1 comprises a section 15 for transversally cutting the corrugated cardboard strips coming from section 13, a double conveyor 17 and, lastly, two areas 19A and 19B for stacking the cardboard sheets cut in section 15 and fed by means of the double conveyor 17.

In section 4, a first single facer 21 is arranged. Single facers usable for producing a single-faced corrugated cardboard sheet are known in the art. Only the main elements of the single facer will be described hereunder, the single facer being for example as described in U.S. Pat. No. 8,714,223 or in EP 1362691, the content whereof is included herein by reference.

Briefly, the single facer 21 (see the enlargement of FIG. 3) may comprise a first corrugating roller 23 co-acting with a second corrugating roller 25 and a pressure roller 27, or other pressure member, to join a smooth cardboard sheet and a corrugated cardboard sheet to one another, as described hereunder. A first smooth cardboard sheet N1 is fed to the single facer 21 from a first unwinder 29. The unwinder 29 may be configured in a known manner and will not be described in detail. The unwinder 29 may comprise two positions for a first, unwinding reel B1, from which the first smooth cardboard sheet N1 is supplied, and a second, stand-by reel B1X, which will be unwound when the reel B1 is exhausted.

A second smooth cardboard sheet N2 is unwound from a second unwinder 31, which can be substantially the same as the unwinder 29, and onto which a first reel B2, from which the cardboard sheet N2 is unwound, and a second stand-by reel B2X are arranged, the stand-by reel B2X starting to be unwound when the reel B1 is exhausted.

The first smooth cardboard sheet N1 is fed to the corrugating roller 23, after having been passed around a heating roller 33. The arc of contact of the cardboard sheet N1 on the heating roller 33 can be modified in order to transfer to the smooth cardboard sheet N1 a greater or lower amount of heat from inside the heating roller 33, for example heated with steam circulating therein.

The first smooth cardboard sheet N1 is corrugated passing through the nip formed between the corrugating rollers 23 and 25. Onto the flutes formed on the corrugated cardboard sheet a suitable glue is applied by means of a gluing unit 35, so that the corrugated cardboard sheet N1 can be glued onto the smooth cardboard sheet N2 fed, together with the corrugated cardboard sheet N1, through the nip formed between the second corrugating roller 25 and the pressure roller 27.

The gluing unit 35 may comprise an applicator roller 36, contacting the flutes of the cardboard sheet N1 entrained around the second corrugating roller 25. The applicator roller 36 receives glue from a distributing roller or screened roller 38, which takes glue from a tank 40 or the like. The distance between the rollers 36 and 38 can be adjusted in order to adjust the amount of glue applied onto the corrugated cardboard sheet N1.

In some embodiments, the second smooth cardboard sheet N2 may be fed around one or more rollers 37, 39 arranged between the unwinder 31 and the single facer 21, in order to be heated. The contact arc between the smooth cardboard sheet N2 and any one or both of the rollers 37, 39 can be modified to vary the amount of heat transferred by the roller(s) 37, 39 to the smooth cardboard sheet N2 before it comes into contact with the pressure roller 27. Also the pressure roller can be heated internally to glue the cardboard sheets N1 and N2 under high pressure and high temperature conditions.

At the output of the single facer 21, a single-faced corrugated cardboard sheet NS is obtained, formed by the first corrugated cardboard sheet N1 and the second smooth cardboard sheet N2, as shown in the enlargement of FIG. 2. The crests or flutes O formed on the first cardboard sheet N1 are glued by glue C, applied by the gluing unit 35 to the flutes O, onto the surface of the smooth cardboard sheet N2 facing the corrugated cardboard sheet N1.

Downstream of the single facer 21 a bridge 41 is arranged, which extends towards the section 5 and the following sections 7 and 9 of the plant 1. On the bridge 41 a stock S of single-faced corrugated cardboard sheet NS can be formed, with the formation of suitable accumulation folds, so that the operating speed of the single facer 21 can be made, at least partially, independent of the operating speed of the downstream sections.

The single-faced corrugated cardboard sheet NS is then fed along a first path which extends on the bridge 41 up to a heating roller 43, around which the single-faced corrugated cardboard NS can be entrained for an adjustable arc, to be appropriately heated before reaching the series of hot plates of section 9.

In the illustrated embodiment, the plant 1 comprises a second section 5 substantially equal to the section 3, where a second single-faced corrugated cardboard sheet, still indicated with NS, is formed, by means of a further couple of cardboard sheets N4, N5 coming from unwinders similar to unwinders 29 and 31, and a single facer similar to single facer 21. This second single-faced corrugated cardboard sheet NS is fed to the bridge 41 to form a stock S and is fed towards the series of hot plates of section 9, being first entrained around a heating roller 45, substantially equal to the heating roller 43.

In other embodiments, the section 5 and the respective single facer may be omitted. In further embodiments, vice versa, more than two sections 3, 5 may be provided, with respective single facer and cardboard sheet unwinder, to produce respective single-faced corrugated cardboard sheets NS, which are then glued together by means of the series of hot plates of section 9.

A smooth cardboard sheet N3 is unwound from a further unwinder 47 and fed, preferably passing around a heating roller 49, to the section 9 of the series of hot plates., In a known manner, gluing units 51, 53 apply a glue onto the flutes of the respective corrugated cardboard sheet of the two single-faced corrugated cardboard sheets NS, to glue them together and with the smooth cardboard sheet N3, which will form the second outer cover of the composite corrugated cardboard CC exiting section 9, the first outer cover being formed by the smooth cardboard sheet N2.

The section 9 containing the series of hot plates can be configured in a known manner and will not be described in detail herein. Examples of embodiments of the series of hot plates are illustrated in U.S. Pat. No. 7,291,243 and in US 2012/0193026, the content whereof is incorporated herein by reference and which can be referred to for greater details of embodiments of this section of the plant.

In section 11 a transversal rotating shear 61 is arranged, which can perform transversal cuts to completely or only partially sever the corrugated cardboard CC fed from section 9. The transversal rotating shear 61 may be configured for example as described in U.S. Pat. No. 6,722,243, the content whereof is incorporated herein by reference. As will be described in greater detail below, the transversal rotating shear 61 can be particularly used to remove portions of corrugated cardboard CC where there are gluing defects or other defects detected by means that will be described later on.

The corrugated cardboard CC, fed through the slitter-scorer section 13, is divided into strips which can be deviated along two paths defined by the two conveyors 17A, 17B of section 17. Section 13 can be configured in a known manner, for example as disclosed in U.S. Pat. Nos. 5,951,454, 6,165,117, 6,092,452, 6,684,749, 8,342,068 or in other prior art documents cited in the above mentioned patent documents, the content whereof is incorporated herein by reference.

The two conveyors 17A, 17B convey corrugated cardboard sheets generated by transversally cutting the continuous strips of section 15, in order to form stacks P1, P2 on collecting planes 63, 65, known and designed for example as described in EP 1710183, U.S. Pat. No. 5,829,951, or in other patent documents mentioned above, the content whereof is incorporated herein by reference.

To the first single facer 21 a first video camera 71, or a series of video cameras 71 may be associated, which are aligned to one another along the width of the single-faced corrugated cardboard sheet NS, and in a number sufficient to acquire images of the whole width of the surface of the single-faced corrugated cardboard sheet NS facing the video camera 71. On the opposite side of the path of the single-faced corrugated cardboard sheet NS, a second video camera 73, or a series of transversally adjacent video cameras 73, may be arranged to acquire images of the whole width of the surface of the single-faced corrugated cardboard sheet NS facing the second video camera(s) 73. As can be seen in FIG. 3, the video camera(s) 71, 73 are arranged downstream of the area where the corrugated cardboard sheet N1 and the smooth cardboard sheet N2 have been bonded to one another. Therefore, each video camera films one of the two outer surfaces of the single-faced corrugated cardboard NS, once the two cardboard sheets N1, N2 have been glued together. Therefore, the video cameras can detect any gluing defect, or other defects, which appear onto the outer surfaces of the single-faced corrugated cardboard.

The two video cameras or series of video cameras 71, 73 can be connected (as schematically represented by the connections A and B, see FIGS. 1A and 3) to an image processing unit 75, which can be connected to a central control unit 77. It should be understood that the image processing unit 75 and the central control unit 77 may be composed of separated units, or of parts or resources of a single electronic processing device, for example a computer with software and hardware resources for processing the images delivered by the video cameras 71, 73 and for controlling the plant 1 or parts thereof.

The image processing unit 75 processes the images acquired by the video cameras 71, 73 to detect any defect on one or the other face of the single-faced corrugated cardboard NS coming from the first single facer 21.

The image processing unit 75 can be provided with software suitable not only for detecting gluing defects and possibly identifying the causes thereof, or at least classifying them, but also for detecting other defects of the single-faced corrugated cardboard NS, such as spots, breakages, tears or other defects.

In some embodiments the central control unit 77 may be configured for controlling, through a connection C, a marking device 79, which can apply a mark onto the single-faced corrugated cardboard NS at least at the beginning of a defective area, identified by one or the other of the video cameras 71, 73 or groups of aligned video cameras. The marking device 79 may be for example an ink spraying nozzle, the ink being detectable in the visible or in the ultraviolet spectrum, and that can be identified by means of suitable sensors, described below, which can actuate a system for removing the defective cardboard portion. In some embodiments, through the images acquired by one or the other of the video cameras 71, 73, it is possible to mark the single-faced corrugated cardboard sheet NS both at the initial area and end area of the detected defect and possibly also between the beginning and the end of the detected defect, for example with a continuous ink line sprayed by the marking device 79. In this way, the removing members can more easily identify the defective area to be removed. The beginning and the end of the defective area of the single-faced corrugated cardboard sheet NS can be identified with different types of marks.

Even though marking the defective area of the single-faced corrugated cardboard sheet NS can make the removal thereof easier, as it will be clearer from the description below, in other embodiments it is possible to avoid the marking system and "track" the defective area as described below. When a defect is identified, the central control unit 77 start tracking the defective point by means of an encoder associated for example to one of the rollers arranged along the path of the single-faced corrugated cardboard NS, whose peripheral speed is substantially equal to the feeding speed of the single-faced corrugated cardboard NS. Knowing the length of the single-faced corrugated cardboard NS which is between the point where the defect has been identified and the point where the removing devices are arranged, it is possible to send a control signal from the central control unit 77 to the devices for removing the defective portion, when the defective portion achieves said devices. Tracking is facilitated by using known systems that determine the amount (i.e. the length) of single-faced corrugated cardboard NS present on the bridge 41.

Advantageously, one or the other or both the video cameras 71, 73 or groups of aligned video cameras, are arranged between the single facer 21 and the bridge 41, i.e. in a position as near as nearest possible to the point where the single-faced corrugated cardboard sheet NS leaves the single facer 21. This allows detecting any gluing defects immediately at the exit of the machine performing the corrugating and gluing operations. It is therefore possible to promptly act on the operating parameters of the single facer 21, for eliminating the factor causing of the defects.

In fact, if the gluing defect results from a malfunction of the single facer 21, for example lack of glue or an insufficient or excessive amount of glue applied on the cardboard, or from a malfunction of one of its members, the defective portion will be the longer, the longer the time occurred between the defect identification and the action undertaken to remove the cause thereof. Therefore, by arranging the video cameras as near as possible to the position where the single-faced corrugated cardboard NS exits from the single facer 21, it is possible minimize the amount of defected single-faced corrugated cardboard NS produced by the single facer 21.

The central control unit 77 can be connected to an interface 78 that informs the operator about the presence of defects in the single-faced corrugated cardboard NS. The interface 78 can comprise a monitor or a display and/or devices for generating an optical or acoustic signal, or a different signal. In addition, also the kind of detected defect may be signaled to the operator, if the image processing unit 75 is provided with software suitable thereto.

In some embodiments, comparing software may be provided to classify the detected defects, by comparing information contained in the acquired images and information gathered from sample images. From the comparison, the processing system is able to discriminate the kind of defect and possibly provide instructions for modifying one or more operating parameters of the line or plant 1. For example, the system can be programmed to distinguish between spots, tears or folds of the cardboard, splicing lines between cardboard sheets, gluing defects as delamination, bubbles, and blisters. The cardboard portions containing the defects shall be removed. The different gluing defects can be due to different factors, and distinguishing among the kind of defects is useful for the plant managing system to act automatically—or to inform the operator about the need for a manual action—on one or more parameters of the line.

In some embodiments, a data base 76 may be associated to the central control unit 77 and/or the image processing unit 75 (FIG. 3A). The data base 76 can contain information about defect images acquired experimentally that can be used by the central control unit 77 and/or by the image processing unit 75 in order to perform a comparison between the acquired images and the images stored in the data base, so as to classify the kind of defect.

For example, the splicing area between the tail edge of a cardboard sheet coming from a first, exhausted reel and the leading edge of a cardboard sheet coming from a second reel generates a net image of a transversal line on the corrugated cardboard. This image is easy to detect and identify. It indicates that a portion of the corrugated cardboard containing the splicing has to be removed, as the final product should not contain splicing portions visible on the outside, but the detected defect does not require adjustment of any operating parameter.

In advantageous embodiments, the central control unit 77 may be connected (as generically indicated by connection D, FIG. 3) to a controller 81 or to another managing system associated to the single facer 21. The controller 81 can be so programmed as to act on one or more operating parameters of the single facer 21, upon signaling from the central control unit 77, in order to remove or reduce the factor having resulted in the gluing defect. In other embodiments, the operating parameter(s) can be managed directly by the central control unit 77.

The operating parameters onto which the control system of the plant 1 can act may comprise for example the pressure between the second corrugating roller 25 and the pressure roller 27. This pressure can be increased or decreased according to the kind of detected gluing defect. To the gluing unit 35 another operating parameter may be associated, which can be controlled by the defect detecting system and by the plant control system. For example, it is possible to increase or decrease the amount of glue applied by adjusting the distance between the rollers 36 and 38 (FIG. 3) of the gluing unit 35.

Further operating parameters, which can be modified in case of gluing defects detected by video cameras 71 and/or 73, can comprise the feeding speed of cardboard sheet N1 and/or of cardboard sheet N2.

As gluing depends also on the temperature at which the reciprocal contact between the corrugated sheet N2 and the smooth sheet N1 occurs, temperature is a further operating parameter which can be controlled and modified to avoid gluing defects. The temperature can be the temperature of the cardboard sheet N1, the temperature of the cardboard sheet N2 or both temperatures of cardboard sheets N1 and N2. The temperature of the cardboard sheet N1 can be controlled for example by acting on the inner temperature of the heating roller 33 and/or on the contact arc between the cardboard sheet N1 and the heating roller 33, which can be modified in a known manner by acting on the position of guiding rollers of the cardboard sheet N1, that define the path of the cardboard sheet N1 around the heating roller 33.

In some embodiments, it is possible to modify the contact arc between the cardboard sheet N2 and any one of the rollers 37, 39. In some embodiments, it is also possible to modify the contact arc between the corrugating roller 25 and the single-faced corrugated cardboard sheet NS exiting the nip defined between the second corrugating roller 25 and the pressure roller 27, for example by modifying the position of a return roller 26 (FIG. 3).

In some embodiments, the image processing unit 75 and/or the central control unit 77 may be programmed such as to identify a gluing defect, for example a delamination, and, based on the kind of defect, automatically act—or suggest to the operator to manually act—on one or more operating parameters of the single facer. For example, the detection of delamination areas can indicate an insufficient gluing temperature, an insufficient gluing pressure or an insufficient amount of glue. However, based on the actual parameters, the delamination can also indicate the presence of an excessive amount of glue with respect to the cardboard feeding speed, or of the gluing pressure, or of the cardboard temperature. The central control unit 77 can act on one or on the other or on several parameters, for example according to their actual value. If the gluing pressure is already very high, the central control unit 77 can act on the cardboard temperature and/or the amount of glue, or on the feeding speed.

If the amount of glue is high and the temperature and/or the gluing pressure are low, the central control unit 77 can act increasing the cardboard temperature and/or the gluing pressure.

Other interventions can be performed if, instead of delamination, bubbles or blisters are detected. Typically, these defects occur if an excessive amount of glue is applied and/or excessive heat is transferred to the cardboard. In both cases bubbles or blisters are associated to the excessive water evaporation due to the excessive amount of glue (which contains 75% of water), or to the excessive heating which results in the evaporation of almost all the water contained in the cardboard. The defects are generated in the single facer and their detection directly downstream of the single facer allows acting promptly on the production parameters, adjusting them and eliminating or reducing the defect. Interventions can be, for example, the reduction of the applied amount of glue and/or the reduction of the heat transferred to the cardboard. The selection of the operating parameter to be adjusted can depend on actual value thereof. For example, if the applied amount of glue is already small, a further reduction could result in the delamination of the cardboard, thus the parameter to adjust will preferably be the amount of heat transferred to the cardboard. Vice versa, if the amount of heat transferred to the cardboard is already small, it is possible to act by reducing the amount of applied glue. In other cases it could be possible to act on both these parameters.

The transferred heat can be modified for example by acting on the temperature of the heating rollers and/or on the contact angle between cardboard sheets and heating rollers. In this case again, the parameter can be selected according to the actual value of these parameters.

The amount of glue can be modified by acting on the distance between the glue dispenser roller and a corrugating roller.

In general, the system allows on one hand to classify the kind of defect and on the other hand to select at least one operating parameter among a plurality of operating parameters, onto which act to correct, reduce or eliminate the defect.

The intervention on the operating parameters of the single facer 21 by means of the central control unit 77, following the detection of a gluing defect by the video camera(s) 71, 73, can constitute the only managing system of the plant, or can simply constitute an aid for the operator, which may act anyway, for example on the parameters controlled by the controller 81 or directly by the central control unit 77, through the interface 78 and the central control unit 77.

Alternatively, or in combination to the intervention on the operating parameters, it is also possible to provide for the central control unit to perform a temporary stop of the plant 1, to allow an operator to act and remove the factor causing the defect.

A substantially equivalent arrangement can be provided for the second single facer provided in section 5, not described in detail. The image processing unit and the central control unit may be different from those of the first single facer in section 3. In some embodiments, each single facer may be combined to a respective image processing unit and to a respective central control unit. Vice versa, in other embodiments, a common central control unit and a common image processing unit may be provided for several single facers. Or several image processing units, for several single facers, may be interfaced with a single central control unit.

The position of the video cameras 71, 73 described above is an optimal position, as it allows the prompt detection of defects, but it is also possible, even if less advantageous, to provide the video cameras in a different position along the path of both the single-faced corrugated cardboards NS produced by sections 3 and 5 respectively.

In some embodiments, on the path of the single-faced corrugated cardboard sheet NS (both the one produced by section 3 and the one produced by section 5) a detector can be arranged, for detecting the mark applied by the marking device 79 or similar marking device associated to the second single facer of section 5, in order to subsequently remove the defective portion of single-faced corrugated cardboard sheet, or of the corrugated cardboard CC containing the defective portion of the single-faced corrugated cardboard sheet, in a suitable area of the plant 1.

Just by way of example, in FIG. 1(B) a detector 87 is shown, which can be arranged in section 7, in a section wherein the single-faced corrugated cardboard sheet NS is tensioned for example between groups of feeding rollers or guiding rollers. The detector 87 can be a sensor or a video camera or any other system suitable to detect the mark applied by the marking device 79. The detector 87 can interface (as schematically indicated by a connection E) the central control unit 77, for the purposes described hereinafter. Number 89 indicates a second marking detector which can be arranged to detect marks applied on the single-faced corrugated cardboard sheet NS produced by section 5.

In the path downstream of the detector 87 or 89, the single-faced corrugated cardboard sheet NS is tensioned, and similarly also tensioned is the corrugated cardboard obtained in section 9 by gluing one or more single-faced corrugated cardboards NS to one another and to the cover N3. Therefore, it is possible to detect a mark by means of the detector 87 and track the position of the mark along the feeding path downstream of the detector 87 or 89, for example by means of an encoder, which can be applied to any of the rollers rotating at a peripheral speed corresponding to the feeding speed of the respective single-faced corrugated cardboard sheet NS and/or of the composite corrugated cardboard CC obtained by bonding the single-faced corrugated cardboard sheet(s) NS to the cover N3.

In this way it is possible to track a mark detected by the detector 87 or 89 along the whole following path up to the position where the removing members, for removing the defective corrugated cardboard portion, are arranged.

In some embodiments, a respective encoder 91 or 92 may be provided, applied to a roller adjacent to the position of the detector 87 or 89.

In the illustrated embodiment two encoders 91 and 92 are indicated, arranged in a suitable position along the path of the two single-faced corrugated cardboard sheets NS. If the plant is configured to process a single single-faced corrugated cardboard sheet, a single encoder may be provided. In general, it is possible to provide as many encoders as many the paths of single-faced corrugated cardboard sheet NS. Alternatively, or in combination, a single encoder may be provided downstream of the series of hot plates, where the different single-faced corrugated cardboard sheets have been bonded together and form a single composite cardboard sheet CC.

To remove the corrugated cardboard defective portion, the transversal rotary shear 61 can be used, for example. This can be interfaced (as schematically indicated by a connection F) to the central control unit 77, to receive instructions for removing a corrugated cardboard CC defective portion. These instructions can be a command of transversal cut at the beginning of the defective portion and a subsequent command of a second transversal cut at the end of the passage of the defective area. The defective cardboard portions, indicated with CD, can be collected in a carriage 93.

In some embodiments, the plant of the invention may remove a defective portion, for example a portion with a gluing defect, as described below.

The gluing defect is detected by the video camera 71 or the video camera 73, when it passes between the exit of the single facer 21 and the entrance of the bridge 41. After the defect has been detected, through the image processing performed by the image processing unit 75, the marking device 79 is actuated, which can for example apply a mark at the beginning of the defective area by spraying a suitable ink on the single-faced corrugated cardboard sheet NS passing in front of the marking device 79. In some embodiments the mark may be applied along a longitudinal edge of the single-faced corrugated cardboard sheet NS, in a cardboard area which is removed during the subsequent operations.

In some embodiments, as mentioned above, an ink invisible to the human eye may be used, for example an ultraviolet ink, to prevent the corrugated cardboard portions that have not been removed from being soiled by a visible ink.

If the operator, or the central control unit 77 in the above described manner, acts on one or more operating parameters, adjusting the gluing defect, the video cameras 71, 73 will detect the end of the defective area and, by means of the central control unit 77, actuate for example the application of a second mark by the marking device 79. The two marks at the beginning and at the end of the defective portion can be different from each other, to allow the detecting device downstream to distinguish the leading and the trailing areas of the defective portion to be removed.

When the mark achieves the detector 87, the latter will emit a signal of detection of the beginning of the defective portion and will actuate the tracking process of that point of the single single-faced corrugated cardboard sheet along the subsequent path. Feeding can be controlled by means of encoder 91. In this way, knowing the length of the path between the detector 87 and the transversal rotary shear 61, the central control unit 77 can send a command signal (through connection indicated with F) to the transversal rotary shear 61, once it has calculated, based on the information provided by the encoder 91, that the beginning of the defective area detected by the detector 87 has achieved the rotary shear 61. When this occurs, the rotary shear 61 will perform a complete transversal cut of the corrugated cardboard CC, inside which there is the defective portion of the single single-faced corrugated cardboard sheet NS, detected by the video camera 71 or 73.

A similar process is performed to track the mark at the end of the defective portion, until this achieves the transversal rotary shear 61, which will be controlled to perform a second transversal cut. The defective sheet CD is discarded in the basket 93.

In other embodiments, a single mark at the beginning of the defective portion may be provided, together with a determination of the length of the defective portion, by means for example of the encoder associated to one of the return rollers of the single single-faced corrugated cardboard NS upstream of the bridge 41. This is possible by using the images detected by one or the other of the video cameras 71, 73 and processed by the image processing unit 75. In fact, the viewing system composed by the video cameras 71, 73 and by the image processing unit 75, is able to detect when the single-faced corrugated cardboard NS has no longer defects. The length of the defective area is stored and subsequently used to determine after which length of cardboard, from the mark at the beginning of the defective portion, the rotary shear 61 should perform the second transversal cut, with which to separate the defective portion from the corrugated cardboard sheet CC.

As mentioned, in some embodiments the marking is not provided. In this case, the cardboard defective portion, detected by the viewing system, is tracked by means of one or more encoders, for example by means of the encoders 91 or 92, or by means of an encoder arranged in another position along the path of the corrugated cardboard. In general, in the prior art plants, devices to determine the amount of cardboard on the bridge 41 are provided, and therefore, using an encoder 91 or 92 and signals generated based on the images acquired by the video cameras 71, 73, it is possible to track the detected defect based on the signal of the respective encoder, and thus to know when the defect achieves the removing area in section 11.

In other embodiments, the removing system for removing the corrugated cardboard defective portion may be different. For example it may be provided for the portion of defective cardboard to pass along the entire path up to the station 15, where transversal cutters are provided which cut the strips of corrugated cardboard at the desired transversal length. If the viewing system has detected a defective portion, the latter can be tracked in the manner described above until it achieves the station 15. When the tracking system identifies, as described above, that the defective portion has achieved the station 15, the transversal cutters that cut the cardboard strips into single sheets, are controlled to temporarily modify the length of the obtained sheets, for example by performing transversal cuts at a greater (or preferably smaller) distance from each other with respect to the set distance. Thus, the defective portion of the cardboard CC will be divided in cardboard sheets, each of which has length which is greater (or smaller) than the cardboard sheets without defects.

The sheets of greater (or smaller) length can then be removed manually from the stacks P1 and P2 formed in the stacking devices 19A and 19B. Manual removal of the sheets from the stack is facilitated by realizing defective cardboard sheets of greater length with respect to the set length.

In other embodiments, discarding systems may be provided for the defective portions of corrugated cardboard CC also in section 15, for example baskets arranged under the conveyors, where the defective portions of corrugated cardboard CC are deviated once they have been detected by the viewing and tracking systems described above.

The tracking and automatic removing process of the defective areas can be used both for defects detected by the video cameras 71, 73 associated to the single facer, and for defects detected by video cameras 101, 120, 121.

In advantageous embodiments, the plant 1 may be provided with further video cameras for the viewing system. In some embodiments, video cameras 101 may be provided in section 15, upstream of the transversal rotary shear, in section 13 downstream of the slitter-scorer unit, or in other suitable positions. The video cameras 101 may be arranged on both sides of the path of each corrugated cardboard CC strip generated in section 13. The additional video cameras 101 can be used to detect further defects of the corrugated cardboard CC, for example breakages and spots that can be generated along the cardboard processing line, downstream of the single facer 21.

The video cameras 101 can interface the image processing unit 75, or another image processing unit dedicated to the video cameras 101, to provide data about defects of the corrugated cardboard CC to the central control unit 77, in order to actuate removing systems for removing defective portions, for example arranged in section 15 or downstream of section 15, generating for example anomalous length sheets, typically having a length smaller than the set length, and which will be removed from the stacks formed in the stacking devices 19A, 19B.

In addition to, or alternatively to the video cameras 71, 73, 101 described above, in some embodiments video cameras 120, 121 may be provided, downstream of the series of hot plates, for example in section 9 or in section 11, as schematically indicated in the drawing. The video cameras 120 and 121 can be arranged facing the two opposite faces of the composite corrugated cardboard CC, coming out from the hot plates, to detect defects on the covers, that is on the two outer smooth cardboard sheets, or also inner defects, as gluing defects of the corrugated cardboard sheets which can result in irregularities visible also outside the cardboard CC.

Once defects, for example gluing defects, have been detected by the video cameras 120, 121 the control unit may trigger an adjustment process to adjust one or more operating parameters of the series of hot plates. For example the temperature of the series of hot plates, or the pressure with which the corrugated cardboard is pressed against the hot plates, or the amount of glue distributed by one and/or the other of the gluing units 51, 53, can be increased or reduced. It is also possible to modify the pressure and/or temperature profiles along the longitudinal extension of the series of hot plates. Since the series of hot plates extends for several meters in the corrugated cardboard feeding direction, it is possible to vary the temperature in the different areas from the entrance to the exit of the series of hot plates. Alternatively or in addition, it is possible to vary the contact pressure between the cardboard and the hot plates from the entrance to the exit of the section of hot plates.

In general, one or more video cameras described above, or additional video cameras suitable for the purpose, can work exclusively, or additionally in the IR-spectrum and can be used to detect the temperature of the corrugated cardboard. The temperature detection can be useful to control one or more operating parameters of the line to adjust any deviation of the detected temperature from a set temperature value.

For example, the contact arc between one or more cardboard sheets and the respective heating rollers can be modified. Or, the temperature of the heating rollers can be increased or decreased according to the requirements.

The viewing system described above can be used also to detect joining defects in the spliced area between cardboard sheets fed by different reels, when an exhausted reel is replaced with a new reel in one of the plant unwinders, and the two cardboard sheets are spliced together.

Substantial advantages in terms of automation of trimming removal and increase in the productivity can be obtained by using video cameras 71, 73, 101, 120, 121, using a mechanism for removing automatically the defective areas, and using a tracking system for tracking the defective area (with tracking by means of an encoder and/or a marking system).

In a further development of the system described above, the information issued by the video camera(s) of the viewing system can be used together with information issued by other components of the corrugated cardboard processing line. In fact, several operating parameters are known and controlled for each section and machine of the processing line. These operating parameters can be set by an operator, or can be controlled by an electronic controlling program. In some embodiments, each operating parameter of a series of operating parameters is kept within a value range. In the case of the single facer, for example, the cardboard feeding speed, the gluing pressure, the amount of glue, the distance between the rollers 36, 38 of the gluing unit 35, the temperature of the heating members, etc. can be controlled. The central control unit 77 can combine the information issued by the viewing system with the operating parameters, for example to provide a more precise diagnosis of the kind of detected defect. Particularly, the central control unit 77 can be so programmed as to combine the detected gluing defects with an error on the controlled operating parameters, in order to provide a more precise information to the operator and/or to perform an automatic adjustment of the parameters in order to counteract, reduce or remove the detected gluing defect.

It is understood that the drawing only shows an example provided by way of a practical arrangement of the invention, which can vary in forms and arrangement without however departing from the scope of the concept underlying the invention. Any reference numerals in the appended claims are provided to facilitate reading of the claims with reference to the description and to the drawing, and do not limit the scope of protection represented by the claims.

The invention claimed is:

1. A plant for producing corrugated cardboard, comprising in combination:

a single facer comprising: a first corrugating roller and a second corrugating roller co-acting with each other to corrugate a first cardboard sheet; a pressing member to glue the first cardboard sheet, corrugated by the first corrugating roller and the second corrugating roller, to a second smooth cardboard sheet and form a single-faced corrugated cardboard;

a first unwinding device to feed the first cardboard sheet to the single facer;

a second unwinding device to feed the second cardboard sheet to the single facer;

a feeding path for the single-faced corrugated cardboard towards a series of hot plates;

a third unwinding device to feed a third sheet of smooth cardboard to the series of hot plates, the third cardboard sheet being glued to the single-faced corrugated cardboard on said hot plates;

a removing device for removing defective cardboard portions;

a central control unit;

a viewing system comprising: at least one video camera arranged along the feeding path downstream of the pressing member of the single facer, configured and arranged to acquire images of a first face of the cardboard; and an image processing unit, interfaced with the at least one video camera and configured to process images acquired by the at least one video camera and to detect defects in cardboard gluing or corrugating;

a tracking system to track a defective cardboard portion up to the removing device.

2. The plant according to claim 1, wherein a first video camera of the at least one video camera is arranged along the feeding path for the single-faced corrugated cardboard to acquire images of the single-faced corrugated cardboard coming from the single facer.

3. The plant according to claim 2, wherein the at least one video camera further comprises a second video camera arranged along the feeding path, configured and arranged to acquire images of a second face of the cardboard, the image processing unit being interfaced with the second video camera detecting defects in the second face of the cardboard.

4. The plant according to claim 3, wherein the second video camera is arranged along the feeding path for the single-faced corrugated cardboard, to acquire images of the single-faced corrugated cardboard coming from the single facer.

5. The plant according to claim 1, further comprising a bridge for forming a stock of single-faced corrugated cardboard coming from the single facer, and arranged between the single facer and the hot plates.

6. The plant according to claim 5, wherein the at least one video camera includes a first video camera and a second video camera, wherein the first video camera, or the second video camera, or both the first video camera and the second video camera, are arranged between the single facer and the bridge.

7. The plant according to claim 1, wherein the viewing system further comprises one or more video cameras arranged downstream of the series of hot plates, and wherein the image processing unit is configured and arranged to acquire images of a first face, or of a second face, or of both a first face and a second face, of the corrugated cardboard coming from the series of hot plates, and to detect gluing defects in said corrugated cardboard coming from the series of hot plates.

8. The plant according to claim 1, wherein the central control unit is interfaced with the single facer and is configured to modify at least one operating parameter of the single facer when the image processing unit detects a gluing defect.

9. The plant according to claim 8, wherein said at least one operating parameter is selected from a group comprising: rotation speeds of the first corrugating roller and the second corrugating roller; operating temperature; temperature of the first cardboard sheet; temperature of the second cardboard sheet; gluing pressure of the first cardboard sheet and the second cardboard sheet; amount of glue applied to the corrugated cardboard sheet.

10. The plant according to claim 1, wherein the central control unit is interfaced with the series of hot plates and is configured to modify at least one operating parameter of the series of hot plates when the image processing unit detects a gluing defect.

11. The plant according to claim 10, wherein the at least one operating parameter of the series of hot plates is selected from a group comprising: pressure of the cardboard onto the series of hot plates; temperature of the hot plates; speed of the cardboard onto the hot plates.

12. The plant according to claim 1, wherein one or more of said at least one video camera are IR-sensitive and the viewing system is configured to detect the cardboard temperature based on images detected by said IR-sensitive video camera(s).

13. The plant according to claim 1, further comprising an encoder determining amount of cardboard moving along the feeding path.

14. The plant according to claim 13, wherein the encoder is interfaced with the central control unit, which is configured to determine, based on a signal from the encoder, the amount of cardboard moving from beginning to end of a defect detected in the cardboard.

15. The plant according to claim 1, further comprising a marking device controlled to apply, on the cardboard, a mark indicating a beginning of a defective portion of the single-faced corrugated cardboard detected by the at least one video camera.

16. The plant according to claim 15, wherein the marking device is controlled to apply, on the cardboard, a mark indicating an end of the defective portion detected by the at least one video camera.

17. The plant according to claim 16, wherein the marking device is controlled to apply different marks to indicate the beginning of the defective portion and the end of the defective portion, respectively.

18. The plant according to claim 15, further comprising a sensor to detect the mark.

19. The plant according to claim 1, wherein either one or both of the central control unit and the image processing unit are configured and arranged to classify a detected defect and, optionally, modify one or more operating parameter of the plant, according to the detected defect, in order to reduce or eliminate the defect.

20. The plant according to claim 1, wherein either one or both of the central control unit and the image processing unit are configured and arranged to select and modify at least one operating parameter of a series of operating parameters of the plant, in order to reduce or eliminate the detected defect.

21. A method for producing corrugated cardboard, comprising steps as follows:

feeding a first cardboard sheet and a second cardboard sheet to a single facer;

corrugating the first cardboard sheet to provide a first corrugated cardboard sheet and gluing the first corrugated cardboard sheet to the second cardboard sheet, forming a single-faced corrugated cardboard;

feeding the single-faced corrugated cardboard and a third smooth cardboard sheet to a series of hot plates;

gluing the single-faced corrugated cardboard to the third smooth cardboard sheet by said series of hot plates;

acquiring, by at least one video camera, images of a first surface of the single-faced corrugated cardboard;

detecting any gluing defects of the single-faced corrugated cardboard in a defective cardboard portion, by processing the images acquired by the at least one video camera;

tracking the defective cardboard portion up to a removing device;

removing the defective cardboard portion.

22. The method according to claim 21, further comprising a step of modifying at least one operating parameter of the single facer, or at least one operating parameter of the series of hot plates, or both at least one operating parameter of the single facer and at least one operating parameter of the series of hot plates, when a gluing defect is detected.

23. The method according to claim 22, wherein said at least one parameter is selected from a group comprising: rotation speeds of a first corrugating roller and a second corrugating roller of the single facer; operating temperature of the single facer; temperature of the first cardboard sheet; temperature of the second cardboard sheet; gluing pressure of the first cardboard sheet and the second cardboard sheet; amount of glue applied onto the first corrugated cardboard sheet; cardboard pressure onto the series of hot plates; temperature of the hot plates; feeding speed of the cardboard.

24. The method according to claim 21, wherein the at least one video camera is arranged between the single facer and a bridge, onto which a stock of single-faced corrugated cardboard is formed.

25. The method according to claim 21, wherein said tracking of the defective cardboard portion includes marking the defective cardboard portion in correspondence to a gluing defect; and using the marking to track and remove the defective cardboard portion.

26. The method according to claim 25, wherein said marking of the defective cardboard portion in correspondence to a gluing defect comprises applying a first mark at a beginning of the defective cardboard portion and a second mark at an end of the defective cardboard portion.

27. The method according to claim 21, further comprising classifying as to type a detected defect and, optionally, act upon one or more operating parameter in order to reduce or eliminate said type of detected defect.

28. The method according to claim 21, further comprising selecting at least one operating parameter among a plurality of operating parameters by a control unit, and acting on said at least one operating parameter to reduce or eliminate a detected defect.

* * * * *